United States Patent [19]

Vroom

[11] 4,147,309

[45] Apr. 3, 1979

[54] HYDROSET PRESSURE RELIEF SYSTEM

[75] Inventor: David Vroom, Tucson, Ariz.

[73] Assignee: Duval Corporation, Houston, Tex.

[21] Appl. No.: 811,208

[22] Filed: Jun. 29, 1977

[51] Int. Cl.[2] ..... B02C 2/04

[52] U.S. Cl. ..... 241/215; 241/290

[58] Field of Search ..... 241/207–216, 241/290; 91/390

[56] References Cited

U.S. PATENT DOCUMENTS

| | | | |
|---|---|---|---|
| 3,133,707 | 5/1964 | Zimmerman | 241/213 X |
| 3,372,881 | 3/1968 | Winter | 241/290 X |
| 3,481,548 | 12/1969 | Beisner et al. | 241/215 |
| 3,801,026 | 4/1974 | Decker et al. | 241/215 |
| 4,060,205 | 11/1977 | Pollak | 241/211 |

*Primary Examiner*—Howard N. Goldberg
*Attorney, Agent, or Firm*—Delmar L. Sroufe

[57] ABSTRACT

A pressure relief system for a gyratory crusher is disclosed in which two separate but interacting fluid assemblies function, respectively, to adjust the operating position of the crusher cone of the gyratory crusher and to control the pressure above which the pressure relief system is activated. The system operates to relieve excessive pressure caused by the introduction of uncrushable foreign matter into the crushing chamber and to facilitate the elimination of such matter from the crusher.

10 Claims, 2 Drawing Figures

X
A
1
2
3
4
5
6
7
8
9
10
11
12
13
14
15
16
17
18
23
29
30
31
32
33
36
37
38
39
40
41
42
43
44
45
B

HYDROSET PRESSURE RELIEF SYSTEM

BACKGROUND OF THE INVENTION

The invention relates to a pressure relief system for a gyratory crusher having a crusher cone that is vertically adjustable by means of a hydraulic fluid assembly to control the size of the crushing gap.

Gyratory crushers with hydraulically-supported crusher cones are known in the prior art, for example Decker et al., U.S. Pat. No. 3,801,026 (1974). Also known in the prior art are pressure relief systems involving a hydraulic fluid assembly and an accumulator to receive displaced hydraulic fluid. Becker, U.S. Pat. No. 2,667,309 (1954).

Previously existing pressure relief systems have consisted of a single fluid assembly connected with one or more accumulators containing a bladder filled with a compressible gas. The fluid assembly is preset to a predetermined pressure, and when the pressure limit is exceeded, a valve is forced open, permitting free flow of the hydraulic fluid into the accumulators, thereby compressing the gas-filled bladders and increasing the pressure in the pressure relief fluid assembly. When the pressure in the crushing mechanism is reduced, the relief valve is forced shut, and the increased pressure in the pressure relief fluid assembly forces the hydraulic fluid from the accumulators back into the cone crusher support system by means of a metering check valve. The crusher cone is thereby raised to its initial crushing gap and normal operation continues.

A problem is often encountered with this type of pressure relief system due to the geometry of the crushing gap between the crusher cone and the outer crushing wall surrounding it. The gap is tapered in such a way that material entering at the top encounters a narrowing separation as it drops downward between the crusher cone and the surrounding wall. As a consequence, a piece of uncrushable foreign matter, which causes an increase in the crushing pressure and activates the pressure relief system, is able to drop only a small distance before becoming caught once more between the crusher cone and the surrounding wall. The increase in crushing pressure again activates the pressure relief system, but this time a greater pressure is required since the pressure relief system has not yet had sufficient time to recover from the first activation and is still at a higher pressure than normal. This sequence of events continues until the foreign matter drops out of the crusher, which may require as many as fifteen or more successive activations of the pressure relief system, each requiring a greater pressure than the preceding. As a result, both the crusher and pressure relief systems see successively larger pressure peaks, three times each second, resulting in vibration and ever greater stresses on the system.

An object of the present invention is to provide a pressure relief system for hydraulically-supported gyratory crushers which is not subject to increasingly large pressure peaks as a piece of uncrushable foreign matter is passed through the system.

Another object of the invention is to allow uncrushable foreign matter to pass through the crusher more easily, without requiring many successive activations of the pressure relief system.

A further object of the invention is to provide a quicker time response to increases in crushing pressure by attaching the pressure relief valve directly to the crusher, rather than communicating with the crusher by means of a pipe line.

Another object of the invention is to facilitate removal of the pressure relief valve for crusher maintenance, and to obviate the need to remove heavy and unwieldy pipes in order to get to the crusher mechanism.

Further details, features and advantages of the invention will be evident from the following detailed description, with reference to the accompanying drawings.

DESCRIPTION OF THE PREFERRED EMBODIMENT

Figure 1:
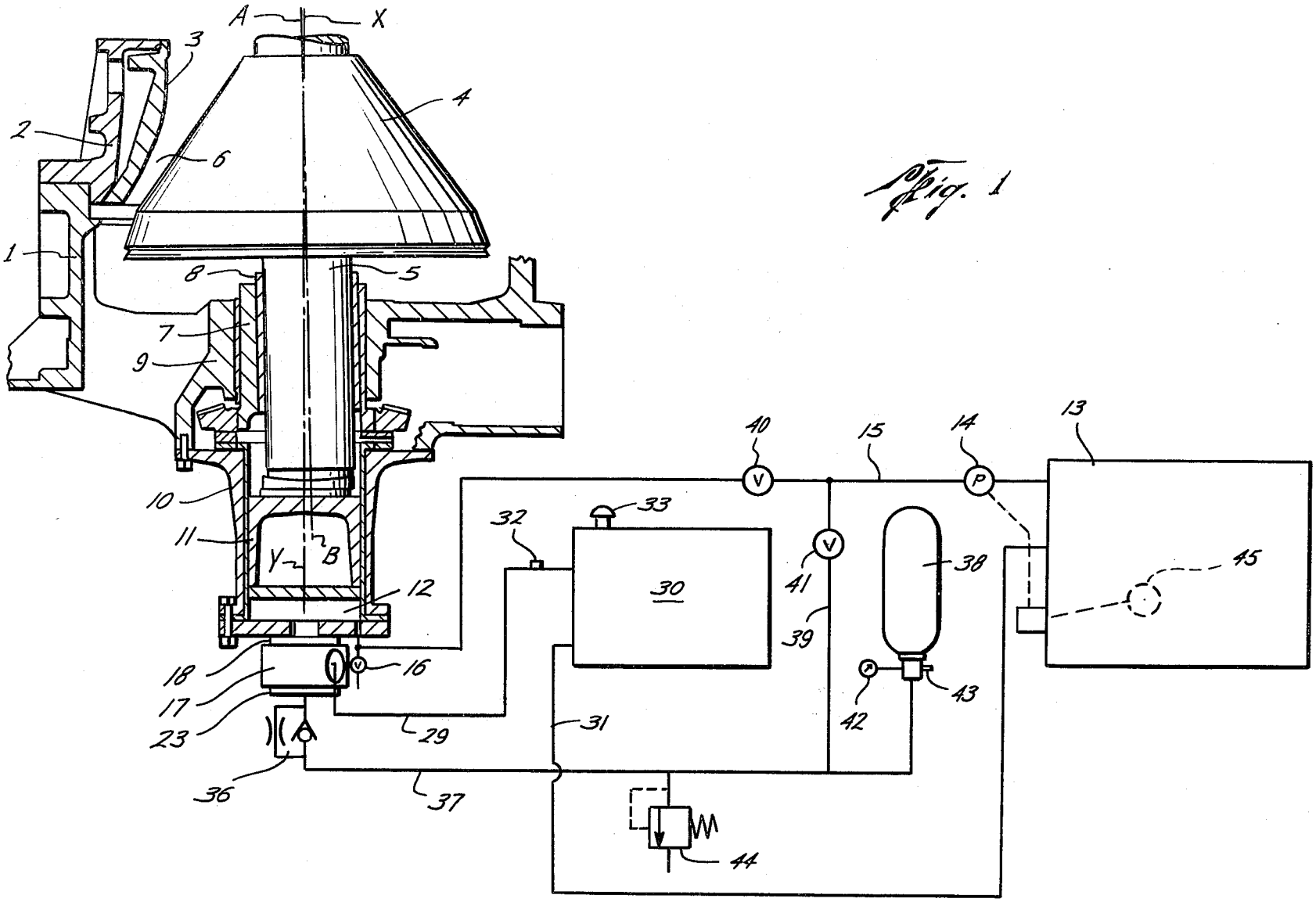
FIG. 1 is a perspective view, partly in vertical cross-section, of a gyratory crusher, with the new pressure relief system shown schematically.

Referring now to FIG. 1 of the drawings, there is shown a gyratory crusher having a supporting frame consisting of a lower frame section 1 and an upper frame section 2. An outer crushing wall or concave 3, open at the top, is supported within the upper frame section 2. A crusher cone 4 is positioned within the upper frame section 2 and outer crushing wall 3. The crusher cone 4 is supported by a vertical shaft 5, of which the longitudinal axis of symmetry A-B is inclined at a small angle to the central vertical axis X-Y of the supporting frame 1 and 2. The lower portion of shaft 5 is held within a cylindrical housing 7 by means of a bearing sleeve or liner 8 positioned within the cylindrical bore. The cylindrical housing 7 is supported for rotation by inner frame member 9 and base portion 10.

The foregoing construction of a gyratory crusher is well known in the art, and the gear and drive shaft mechanism for eccentrically rotating the shaft 5 and imparting a gyratory motion to crusher cone 4 will not be described here. See, for example, Torrence et al., U.S. Pat. No. 3,813,047 (1974).

Shaft 5 and crusher cone 4 may be vertically adjusted by pumping hydraulic fluid from the hydraulic fluid reservoir 13 by means of a pump 14, through supply line 15 and into the space or cavity 12 beneath piston 11, which supports the lower end of shaft 5. The gap 6 between crusher cone 4 and the outer crushing wall 3 may thus be adjusted to any desired crushing size. If necessary, air or excess hydraulic fluid may be discharged manually by means of bleeder valve 16.

FIG. 1 also shows schematically a pressure relief system consisting of a pressure relief valve 17 and two separate but interacting hydraulic fluid assemblies, called herein the fluid discharge assembly and the piston charging assembly, described more fully below. The pressure relief valve 17, as shown in detail in FIG. 2, consists of a top cover plate 18, which attaches directly to the crusher beneath cavity 12 (FIG. 1), a housing 19 with cylindrical bore 20, a relief valve piston or piston valve 21 vertically displaceable within the bore 20, an annular valve seat 22 which determines the upward limit of movement of piston valve 21, and a bottom cover plate 23.

In the preferred embodiment, the upper section 24 of piston valve 21 has a smaller diameter than the lower section 25, with a circumferential edge 26 at the place where sections 24 and 25 join. As a result, when relief valve piston 21 is closed against valve seat 22, the effective surface area of the top face of the valve is less than that of the bottom face, so that a lesser fluid pressure is required at the bottom face of piston valve 21 than at the top face in order for the upward and downward forces on piston valve 21 to be of equal magnitude. However, when piston valve 21 has been pushed downward and away from valve seat 22, the circumferential edge 26 is acted upon by the fluid above piston valve 21, so that the effective surface area acted upon by the downward pressure on piston valve 21 is then equal to the effective surface area of the bottom face of piston valve 21 acted upon by the upward pressure.

The fluid discharge assembly consists of hydraulic fluid reservoir 13, pump 14 and supply line 15 to supply fluid from reservoir 13 to cavity 12, symmetrically spaced discharge ports 27 connecting the interior of cylindrical bore 20 with manifold 28, a pipe line 29 for ducting discharged fluid into surge tank 30, and a return drain line 31 to carry discharged fluid from surge tank 30 to the hydraulic fluid reservoir 13 (shown schematically in FIG. 1). In the preferred embodiment, pipe line 29 has a sight hole 32 for monitoring flow and leakage past piston valve 21, and surge tank 30 has a vent 33 to permit the escape of displaced air as fluid enters the surge tank.

The piston charging assembly consists of a cavity 34 beneath piston valve 21, an access port 35 through bottom cover plate 23, a metering check valve 36 with unrestricted downward flow and metered back flow, and a pipe line 37, which may be a flexible medium- or high-pressure hose, to an accumulator 38. The piston charging assembly also includes, as shown schematically in FIG. 1, a tie line 39 into a fluid charging source, which in the preferred embodiment is comprised of hydraulic fluid reservoir 13 and pump 14, two shut-off valves 40 and 41 for charging the piston charging assembly to the desired pressure, a pressure gauge 42 for monitoring the pressure in the piston charging assembly, a bleeder valve 43 for the manual discharge of air or excess fluid from the system, and a secondary fail-safe pressure relief valve 44 should accumulator 38 become fluid logged.

The accumulator 38 is a standard item, such as a Greer gas-bladder accumulator, Model No. 30A-10HF, and will not be described further. Likewise, safety valve 44 is a standard item, such as a Teledyne valve, Model No. 2745 B1, and will not be described further.

The operation of the new pressure relief system will now be described in a typical situation. Referring to FIG. 1, the piston charging assembly is charged by closing shut-off valve 40, opening shut-off valve 41, and pumping hydraulic fluid, such as oil, from reservoir 13 through lines 15 and 39 into the piston charging assembly until the desired relief pressure has been attained. Valve 41 is then closed, valve 40 is opened, and crusher cone 4 is raised to the desired operating position by pumping hydraulic fluid from reservoir 13 through line 15 into space 12 beneath piston 11. The system is then ready for operation.

Alternatively, the piston charging assembly can be charged to the desired pressure with a suitable gas instead of hydraulic fluid. This can be accomplished by suitable means known to the art, for example, by closing shut-off valve 41 and supplying precompressed gas to the piston charging assembly through bleeder valve 43.

Figure 2:
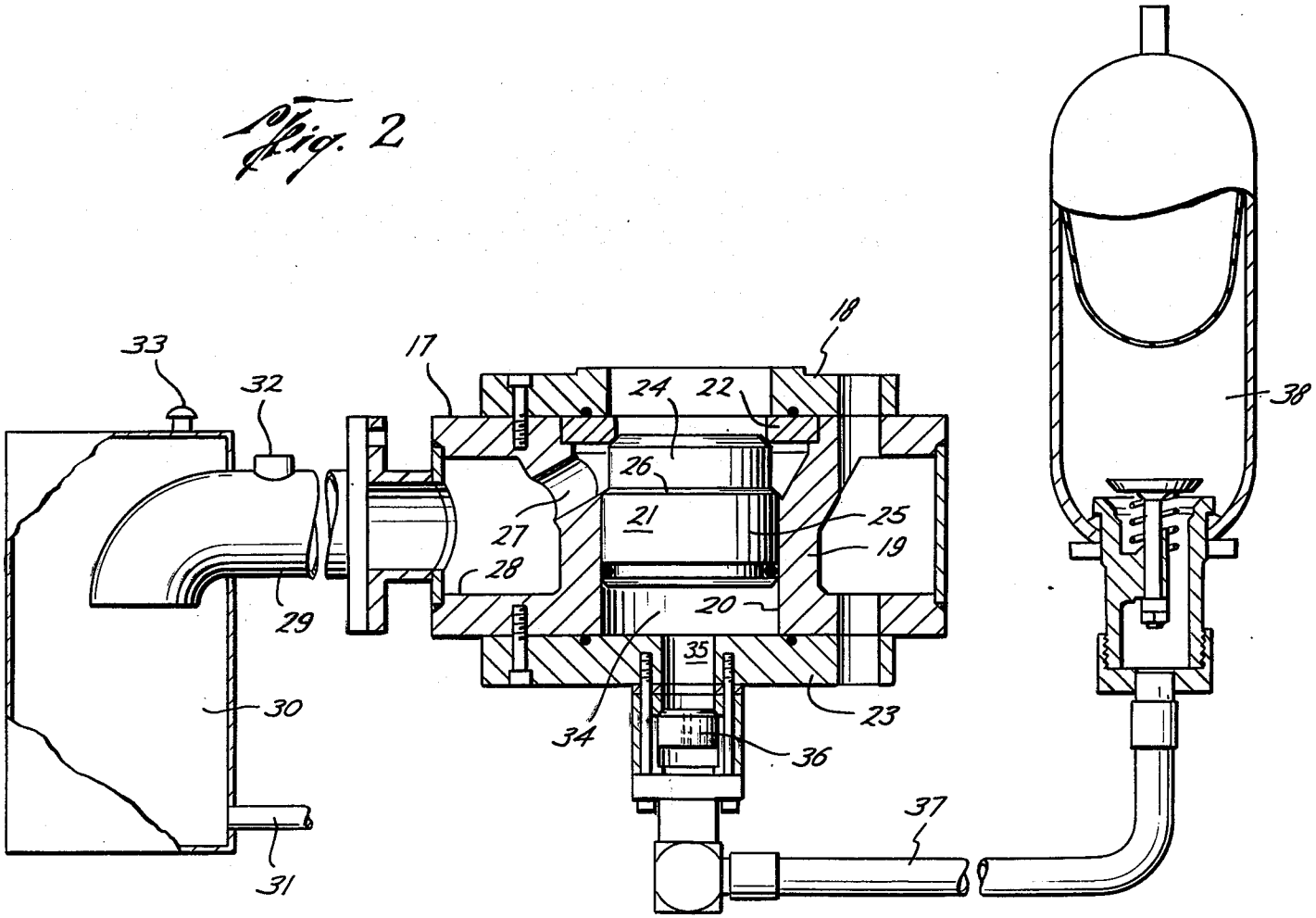
FIG. 2 is a detailed view, partly in vertical cross-section, of the pressure relief system.

Referring now to FIG. 2, the pressure in the piston charging circuit holds relief valve piston 21 against valve seat 22 with a force equal to the pressure in the piston charging circuit times the effective surface area of the bottom face of piston valve 21. The downward force on piston valve 21 is equal to the hydraulic fluid pressure in space 12 beneath piston 11 (FIG. 1) times the effective surface area of the top face of piston valve 21. Piston valve 21 is forced downward and the pressure relief system becomes operative when the downward force on piston valve 21 exceeds the upward force.

Referring now to FIG. 1, when a piece of uncrushable matter enters the gap 6 between crusher cone 4 and outer crushing wall 3, the additional force thereby exerted on crusher cone 4 is transmitted downward through shaft 5 and piston 11 to the hydraulic fluid in cavity 12. When the pressure of the hydraulic fluid in cavity 12 becomes so great that the downward force on piston valve 21 (now referring to FIG. 2) exceeds the upward force on said piston valve due to the pressure of the hydraulic fluid in the piston charging circuit, piston valve 21 is forced downward and the fluid in space 12 (FIG. 1) flows out through the discharge ports 27 into manifold 28, and from there through pipe line 29 into surge tank 30. Referring again to FIG. 1, when the hydraulic fluid in space 12 beneath piston 11 has been thus discharged through pressure relief valve 17, crusher cone 4 moves downward and away from outer crushing wall 3, thereby relieving the pressure on crusher cone 4 and enabling the uncrushable matter in space 6 to drop downward and out of the crushing chamber.

Referring to FIG. 2, the downward movement of piston valve 21 displaces hydraulic fluid from the cavity 34 beneath piston valve 21, through check valve 36 and pipe line 37, and into accumulator 38, accompanied by an increase in the pressure of the hydraulic fluid in the piston charging assembly. As previously mentioned, however, and as shown in FIG. 2, the effective surface area of the top face of piston valve 21 when closed is less than the effective surface area of the bottom face. As a result, piston valve 21 will not be forced downward until the pressure of the hydraulic fluid above piston valve 21 exceeds a value which is greater than the hydraulic fluid pressure below said piston valve. As soon as piston valve 21 is forced open, the circumferential edge 26 is acted upon by the hydraulic fluid above piston valve 21, and the effective surface area of the top of piston valve 21 is then equal to the effective surface area of the bottom of said piston valve. Thus the greater pressure above and the lesser pressure below piston valve 21 now act upon equal surface areas, ensuring that piston valve 21 is forced completely open to allow unrestricted discharge of the hydraulic fluid from space 12.

With the discharge of fluid from space 12 (FIG. 1), the downward pressure on piston valve 21 decreases. When the force on the bottom of piston valve 21 exceeds the force on top, piston valve 21 begins to move up as oil is displaced from accumulator 38 through pipe line 37, and metered through check valve 36. The metering controls the speed with which piston valve 21 is closed and helps to ensure that there is ample time for the discharge of hydraulic fluid and lowering of the crusher cone, so that the uncrushable foreign matter is able to pass out of crushing chamber 6 (FIG. 1).

Referring to FIG. 1, the fluid discharged from cavity 12 beneath piston 11 and carried to hydraulic fluid reservoir 13, as described above, is controllably returned to cavity 12 by means of pump 14 and pipe line 15. In this manner, crusher cone 4 is raised to its previous operating position and normal operation continues. The pump 14 may operate continuously, or a suitable fluid level monitor 45, such as a float, in reservoir 13 may be used to activate pump 14 automatically when the fluid reaches a certain level.

An important point to note is that although the fluid discharge assembly and the piston charging assembly act in concert to relieve excess pressure in the gyratory crusher, they comprise entirely separate mechanical systems. Thus (referring to FIG. 2) after relief valve piston 21 has been opened and hydraulic fluid discharged, the piston charging assembly operates to return relief valve piston 21 to its former closed position against valve seat 22, but plays no part in raising crusher cone 4 (FIG. 1) to its former operating position. As described above (and referring now to FIG. 1), the desired positioning of crusher cone 4 is accomplished by pumping fluid from hydraulic fluid reservoir 13 through pipe line 15 into space 12 beneath piston 11.

Although the foregoing detailed description of the preferred embodiment demonstrates how the objects of the present invention have been attained, modifications and equivalents of the disclosed concepts will be readily apparent to those skilled in the art. Such modifications and equivalents are intended to be included within the scope of this invention, which is limited only by the scope of the claims which appear below.

I claim:

1. In a gyratory crusher having a fixed outer crushing wall and a rotatable inner crusher cone mounted on a vertically adjustable central supporting shaft and separated from the outer crushing wall by an adjustable gap, an improved pressure relief system comprised of two fluid assemblies and a relief valve piston, as follows: (a) a first fluid assembly for vertically adjusting the position of the crusher cone and the corresponding size of the crushing gap by means of hydraulic fluid controllably supplied from a hydraulic fluid reservoir to a cavity beneath the crusher cone central supporting shaft; (b) said relief valve piston attached to the crusher beneath said cavity, the top face of the piston being in contact with the hydraulic fluid supporting the crusher cone and central supporting shaft, which fluid thereby exerts a downward force on the piston; and (c) a second fluid assembly cooperating with the first by providing a preset back force on the bottom face of the relief valve piston, holding the piston upwards against a valve seat, such that the piston is forced downwards when the force exerted by the hydraulic fluid on the top of the piston valve exceeds the back force, thereby allowing the hydraulic fluid in the cavity above the piston to be discharged from that cavity, causing the crusher cone to be lowered and the pressure thereby reduced, the discharged fluid being removed from the cavity between the crusher cone central supporting shaft and the relief valve piston to a reservoir from which it can be controllably returned, independent of the closing of the relief valve piston, to the cavity beneath the crusher cone central supporting shaft to raise the crusher cone to its former operating position.

2. A pressure relief system according to claim 1 wherein the upper portion of the relief valve piston has a smaller diameter than the lower portion, such that when closed the top face has a smaller effective surface area than the bottom face.

3. A pressure relief system according to claim 1 wherein the first fluid assembly consists of a hydraulic fluid reservoir, a pump and supply line to supply hydraulic fluid from the reservoir to the cavity beneath the crusher cone central supporting shaft, discharge ports to permit discharge of hydraulic fluid from said cavity when the relief valve piston is open, a manifold, and a pipe line to carry the discharged fluid from the manifold to the hydraulic fluid reservoir.

4. A pressure relief system according to claim 3 wherein a pipe line carries discharged fluid from the manifold into a surge tank, and a return drain line carries the discharged fluid from the surge tank back to the hydraulic fluid reservoir.

5. A pressure relief system according to claim 1 wherein a fluid level monitor in the reservoir for the discharged fluid activates a pump to return said discharged fluid from the reservoir to the cavity beneath the crusher cone central supporting shaft.

6. A pressure relief system according to claim 1 wherein the second fluid assembly consists of a cavity beneath the relief valve piston, a metering check valve separating said cavity from a pipe line, and said pipe line connected to an accumulator.

7. A pressure relief system according to claim 6 wherein the pipe line to the accumulator consists of a flexible hose.

8. A pressure relief system according to claim 6 wherein the fluid in the second fluid assembly is a suitable liquid, such as oil.

9. A pressure relief system according to claim 6 wherein the fluid in the second fluid assembly is a gas suitable as a pressure transfer medium.

10. In a gyratory crusher having a fixed outer crushing wall and a rotatable inner crusher cone mounted on a vertically adjustable central supporting shaft and separated from the outer crushing wall by an adjustable gap, an improved pressure relief system comprised of two fluid assemblies and a vertically displaceable relief valve piston, as follows:

(a) a first fluid assembly for vertically adjusting the position of the crusher cone and the corresponding size of the crushing gap, said first fluid assembly consisting of a hydraulic fluid reservoir, a pump and supply line to supply hydraulic fluid from the reservoir to a cavity beneath the crusher cone central supporting shaft, discharge ports in the cylindrical wall enclosing the relief valve piston to permit discharge of hydraulic fluid from said cavity when the relief valve piston is open, a manifold, a pipe line to duct discharged fluid from the manifold into a surge tank, and a return drain line to carry the discharged fluid from the surge tank back to the hydraulic fluid reservoir, from which it is controllably pumped to the cavity beneath the crusher cone central supporting shaft to raise the crusher cone to its former operating position;

(b) said vertically displaceable relief valve piston being attached to the bottom of the crusher, the upper portion of said relief valve piston having a smaller diameter than the lower portion, such that when closed the top face of the piston has a smaller effective surface area than the bottom face, the top face being in contact with the hydraulic fluid supporting the crusher cone and central supporting shaft, which fluid thereby exerts a downward force on said piston; and (c) a second fluid assembly consisting of a cavity beneath the relief valve piston, a metering check valve separating said cavity from a pipe line, and said pipe line connected to an accumulator, said second fluid assembly cooperating with the first by providing a preset back force on the bottom face of the relief valve piston, holding said piston upwards against a valve seat, such that said piston is forced downwards to open the discharge ports when the force exerted by the hydraulic fluid on the top of the piston valve exceeds the back force, thereby allowing the hydraulic fluid in the cavity above the piston to be discharged from said cavity through the discharge ports into the surge tank, causing the crusher cone to be lowered and the pressure thereby reduced, the discharged fluid being carried from the surge tank back to the hydraulic fluid reservoir as described in subparagraph (a).

* * * * *